US005437802A

United States Patent [19]

Kurahashi et al.

[11] Patent Number: 5,437,802

[45] Date of Patent: Aug. 1, 1995

[54] LUBRICATING COMPOSITION FOR HOT-ROLLING STEEL

[75] Inventors: Ryuro Kurahashi; Takahiko Kouga, both of Muroran; Masataka Shirata, Kanagawa; Masayoshi Sakakibara, Fujisawa; Hiroshi Kamiyashiki, Chigasaki, all of Japan

[73] Assignees: Nippon Steel Corporation; Kyodo Yushi Co., Ltd., both of Tokyo, Japan

[21] Appl. No.: 266,784

[22] Filed: Jun. 28, 1994

Related U.S. Application Data

[63] Continuation of Ser. No. 915,403, Jul. 20, 1992, abandoned, which is a continuation of Ser. No. 465,092, filed as PCT/US JP89/00591, Jun. 13, 1989, published as WO89/12669, Dec. 28, 1989, abandoned.

[30] Foreign Application Priority Data

Jun. 14, 1988 [JP] Japan ..... 63-144588
May 26, 1989 [JP] Japan ..... 1-134323

[51] Int. Cl.[6] ..... C01M 141/06

[52] U.S. Cl. ..... 252/18; 252/23; 252/25; 252/30; 252/32.5; 252/32.7 E; 252/46.4; 72/42

[58] Field of Search ..... 252/23, 24, 18, 28, 252/27, 25, 30, 32.5, 32.7 E, 46.4; 72/42

[56] References Cited

U.S. PATENT DOCUMENTS

| | | | |
|---|---|---|---|
| 2,176,879 | 10/1939 | Bartell | 252/22 |
| 3,801,503 | 4/1974 | Hartmann | 252/25 |
| 3,931,020 | 6/1976 | Burgess et al. | 252/25 |
| 4,039,337 | 8/1977 | Brown et al. | 252/30 |
| 4,107,058 | 8/1978 | Clarke et al. | 252/18 |
| 4,155,859 | 5/1979 | Higgins | 252/22 |
| 4,268,404 | 5/1981 | Ahlgrim et al. | 252/25 |
| 4,710,307 | 12/1987 | Périard et al. | 252/25 |
| 4,715,972 | 12/1987 | Pacholke | 252/25 |
| 4,758,358 | 7/1988 | Lum et al. | 252/25 |

FOREIGN PATENT DOCUMENTS

| | | |
|---|---|---|
| 0135932 | 4/1985 | European Pat. Off. . |
| 52-101363 | 8/1977 | Japan . |
| 58-1796 | 1/1983 | Japan . |
| 59-81394 | 5/1984 | Japan . |
| 60-6211 | 1/1985 | Japan . |

OTHER PUBLICATIONS

Database WPIL AN-86-217980 (1986) no month available.

Database WPIL AN-82-12688E (1982) no month available.

Japanese Patent No. J6000 6211 Jan. 12, 1985, English abstract.

Schroter et al., Taschenbuch Der Chemie, "Kohlenstoff und Kohlenstoffverbindungen", p. 347 (considered reaction formulas only) no date available.

Schroter et al., Taschenbuch Der Chemie, "Phosphor und Phosphorverbindungen", p. 381 (considered reaction formulas only) no date available.

*Primary Examiner*—Margaret Medley

*Attorney, Agent, or Firm*—Wenderoth, Lind & Ponack

[57] ABSTRACT

Disclosed is a lubricating composition for hot-rolling steel, which comprises a base oil or base grease and a heat-insulating agent. Especially, (A) an inorganic compound which is melted by an absorption of heat at a temperature lower than 1200° C. and (B) an inorganic powder which is not melted or decomposed at a temperature lower than 1200° C. and has a heat conductivity lower than 0.01 cal/cm.s. °C. at room temperature and a friction coefficient smaller than 0.7 are incorporated in specific amounts singly or in combination in the composition. This lubricating composition has an excellent heat-insulating effect and effectively prevents the thermal crown of a work roll.

3 Claims, 1 Drawing Sheet

LUBRICATING COMPOSITION FOR HOT-ROLLING STEEL

This application is a continuation of now abandoned application, Ser. No. 07/915,403, filed Jul. 20, 1992, which is a continuation of now abandoned application, Ser. No. 07/465,092, filed Feb. 13, 1990, which is the national phase of PCT/JP89/00591, filed Jun. 13, 1989.

TECHNICAL FIELD

The present invention relates to a lubricating composition for hot-rolling steel. More particularly, the present invention relates to a lubricating composition by which a transfer of heat to a work roll from a material to be rolled is prevented and the effect of reducing the thermal crown of the work roll is attained by incorporating a specific heat-insulating agent into a base oil or base grease.

BACKGROUND ART

In the conventional hot-rolling method, only roll-cooling water is used for protecting a roll, but now a rolling oil is used for reducing the rolling load and decreasing wear of the roll, and an excellent effect is attained thereby.

The main object of the conventional lubricant for hot rolling is to reduce wear of a work roll and improve the roll surface, because the requirement for the quality of a rolled product is relatively moderate and the thermal crown of the work roll is not regarded as important. Nevertheless, recently, an increased quality of the product has been demanded, and the effect of reducing the thermal crown of the work roll, which has a direct adverse influence on the quality of the product, has become important.

DISCLOSURE OF THE INVENTION

The present invention relates to a lubricant composition for hot-rolling steel, which is characterized in that a heat-insulating agent is incorporated into a base oil or base grease. More specifically, it was found that if two specific kinds of heat-insulating agents, i.e., (A) an inorganic compound which is melted by an absorption of heat at a temperature lower than 1200° C., and (B) an inorganic powder which is not melted or decomposed at a temperature lower than 1200° C. and has a heat conductivity lower than 0.01 cal/cm.s. °C. at room temperature and a friction coefficient smaller than 0.7, are incorporated singly or in combination in specific amounts in the composition, an excellent heat-insulating effect can be attained and the thermal crown of a work roll can be effectively prevented. The present invention was completed based on this finding.

In accordance with the first aspect of the present invention, there is provided a lubricating composition for hot-rolling steel, which comprises a base oil and a heat-insulating agent incorporated therein, wherein the above-mentioned components (A) and (B) are used as the heat-insulating agent. By incorporating the heat-insulating agents (A) and (B) having different properties in combination in the base oil, the heat-insulating effect can be increased by the synergistic effect of these heat-insulating agents.

In accordance with the second aspect of the present invention, there is provided a lubricating composition for hot-rolling steel, which comprises a base grease and a heat-insulating agent incorporated therein, and the above-mentioned component (A) and/or the above-mentioned component (B) is used as the heat-insulating agent. In this aspect, the base grease is used instead of the base oil, and the heat-insulating property is improved by the combination of the base grease with the component (A), the component (B) or the components (A) and (B). Since a grease has a low flowability at a high temperature, compared with an oil, a remarkable effect can be attained in the grease by the addition of the component (A) or (B) alone. If the components (A) and (B) are incorporated in combination, a highest effect can be attained due to the synergistic action of the two components.

In the above-mentioned lubricating composition for hot-rolling, by incorporating an extreme pressure additive and/or a solid lubricant together with the heat-insulating agents (A) and (B), the lubricating property of the base oil can be further improved, and the lubricating property, heat-insulating property, storage stability, working property, and water washing resistance of the base grease can be further improved.

BEST MODE OF CARRYING OUT THE INVENTION

Figure 1:
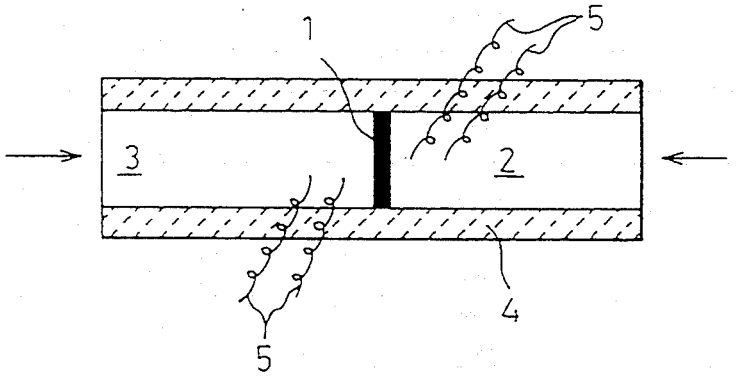
FIG. 1 is a diagram illustrating the method of measuring the contact heat transfer ratio between metals.

The surface temperature of a work roll is elevated to about 800° C. by contact with a material to be rolled. Most of the conventional lubricants for hot rolling comprise a mineral oil, an oiliness agent, an extreme pressure additive, and a solid lubricating agent, in combination, and although the lubricating property is taken into consideration, an insulation of heat (prevention of transfer of heat to the work roll from the material to be rolled) is not considered.

Japanese Unexamined Patent Publication No. 60-6211 teaches that a roll can be protected by adding a fine powder of an inorganic compound having a melting point lower than 1200° C. under atmospheric pressure, an average particle size smaller than 1 μm, and no corrosive action on iron and steel including cast iron and cast steel and other metals, and acting as a substance having a poor heat conductivity to a commercially available hot-rolling oil (liquid).

The base oil disclosed in this patent publication is a commercially available hot-rolling oil (liquid) and is different from the base grease used in the second embodiment of the present invention. Furthermore, the powder used in the invention of the-above-mentioned patent publication is a powder of an inorganic compound which melts at a temperature lower than 1200° C., and the heat transfer-preventing effect is drastically reduced after melting.

In the present invention, where a liquid base oil is used, an inorganic compound melting at a temperature lower than 1200° C. and an inorganic powder not melting or decomposing at a temperature lower than 1200° C. are used in combination, and where a base grease as semi-fluid grease having a higher heat-insulating property than that of the liquid base oil is used, two kinds of the inorganic powders are added singly or in combination, whereby the heat-insulating property is further increased.

Namely, the heat-insulating agent used in the present invention includes (A) an inorganic compound which is melted by an absorption of heat at a temperature lower than 1200° C. and (B) an inorganic powder which is not melted or decomposed at a temperature lower than 1200° C., is stable against oxidation and has a heat conductivity lower than 0.01 cal/cm.s. °C. at room temperature and a friction coefficient smaller than 0.7. As the inorganic compound (A) which is melted by an absorption of heat at a temperature lower than 1200° C., there can be mentioned solid powders of condensed phosphoric acid salts such as condensed salts of $KPO_3$ and $NaPO_3$ and $K_4P_2O_7$, sodium silicate, chromic acid salts such a $K_2Cr_2O_7$−, and halides such as NaCl, KCl, KF, KBr and KI. Condensed phosphoric acid salts and sodium silicate, which have no corrosive action on a rolling mill or a material to be rolled, are especially preferable.

As the inorganic powder (B) which is not melted or decomposed at a temperature lower than 1200° C., is stable against oxidation and has a heat conductivity lower than 0.01 cal/cm.s. °C. at room temperature and a friction coefficient smaller than 0.7, there can be used boron nitride, silicon nitride, amorphous carbon, $K_3PO_4$, $Ca_3(PO_4)_2$, bentonite, $SiO_2$ and ZnO. The friction coefficient referred to herein is determined by the pin-on-disk method (a rod having a diameter of 3 mm and a flat top end is pressed under a load of 1 kgf against a disk having a diameter of 11 mm, and the disk is slid at a speed of 0.01 ms).

A heat-insulating agent having an average particle size smaller than 50 μm can be used, but in view of the clearance between the roll and the material to be rolled, preferably the average particle size of the heat-insulating agent is smaller than 10 μm.

The reason why better results are obtained when the inorganic compound (A), which is melted by an absorption of heat at a temperature lower than 1200° C., and the inorganic powder which is not melted or decomposed at a temperature lower than 1200° C. and has a heat conductivity lower than 0.01 cal/cm.s. °C. and a friction coefficient smaller than 0.7 are used in combination, has not been completely elucidated, but it is considered that the reason is probably as follows. At the rolling step, the temperature and pressure become high in a roll bite (higher than 600° C. and higher than 2000 kgf/cm$^2$). At this point, the heat-insulating agent (A) is promptly melted by absorption of heat and prevents heat from being transferred to the work roll from the material to be rolled. It is known that the heat conductivity of a liquid is, in general, increased more than that of a powder. Accordingly, it is considered that the heat transfer-reducing effect of the heat-insulating agent (A) is abruptly decreased by melting. On the other hand, since the heat-insulating agent (B) is not melted or decomposed even under high-temperature and high-pressure conditions, the heat-insulating agent (B) is present in the form of a powder in the roll bite and prevents the work roll from falling in contact with the material to be rolled, and it is considered that since the powder per se has a lubricating property, a generation of heat by friction in the roll bite is reduced by the powder of the heat-insulating agent (B).

Namely, although the heat-insulating agent (A) has an excellent heat-insulating property, when the heat-insulating agent (A) is melted at a high temperature, the heat-insulating property is drastically reduced. On the other hand, since the heat-insulating agent (B) is not melted or decomposed at a temperature lower than 1200° C., the heat-insulating agent (B) has a heat-insulating property over a broad temperature range. Accordingly, if the heat-insulating agent (A) and the heat-insulating agent (B) are made present at a specific ratio, a lubricating agent having the excellent effects of both heat-insulating agents (A) and (B) can be obtained.

Preferably, the heat-insulating agent is added in an amount of 5 to 50% by weight, especially 10 to 40% by weight. If the amount of the heat-insulating agent is smaller than 5% by weight, the heat-insulating effect is too low, and if the amount of the heat-insulating agent is larger than 50% by weight, the viscosity of the lubricant becomes too high and the oil-supplying property is degraded. Preferably, the ratio of the heat-insulating agent (A) to the heat-insulating agent (B) is in the range of 49/1 to 1/49, especially 19/1 to $\frac{1}{4}$. This is because, if the proportion of the heat-insulating agent (A) is reduced, the heat-insulating property is lowered by an absorption of heat in the roll bite, and if the proportion of the heat-insulating agent (B) is reduced, the heat-insulating property at high temperature is lowered.

As the base oil that can be used in the present invention, there can be mentioned medium and heavy mineral oils such as spindle oil, machine oil, dynamo oil, motor oil, cylinder oil and bright stock, animal and vegetable oils such as beef tallow, lard, sperm oil, palm oil, coconut oil, linseed oil, rice bran oil and soybean oil, synthetic oils such as esters of fatty acids having 8 to 22 carbon atoms with monohydric or polyhydric alcohols, α-olefins, polybutene, silicone oils and fluorine oils, and mixtures of these oils.

As the base grease that can be used in the present invention, there can be mentioned lithium soap grease, calcium soap grease, sodium soap grease, aluminum soap grease, calcium complex grease, polyurea grease and organo-clay grease. Lithium soap grease, calcium complex grease, polyurea grease and organo-clay grease, which have an excellent heat resistance, are preferable.

As the solid lubricant that can be used in the present invention, there can be mentioned inorganic solid lubricants such as graphite (natural graphite and artificial graphite), molybdenum disulfide, mica (natural mica and artificial mica), fluorinated graphite, boron nitride, soft metals (such as gold, silver and copper) and talc, and organic solid lubricants such as PTFE (polytetrafluoroethylene), MCA (melaminecyanuric acid adduct) and phthalocyanine. Graphite (natural graphite and artificial graphite), mica (natural mica and artificial mica), boron nitride and talc, which have an excellent heat resistance and oxidation stability at a high temperature and have no substantial influence on a material to be rolled, are preferable. Preferably the amount added of the solid lubricant is 0 to 40% by weight, especially 5 to 15% by weight. If the amount of the solid lubricant exceeds 40% by weight, the viscosity of the lubricant becomes too high and the oil-supplying property is reduced.

As the extreme pressure additive that can be used in the present invention there can be mentioned sulfur compounds, phosphorus compounds, chlorine compounds and organic metal compounds. Preferably the amount added of the extreme pressure additive is 0 to 20% by weight, especially 0.5 to 10% by weight. If the amount of the extreme pressure additive exceeds 20% by weight, undesired side effects such as an appearance of a corrosive action and reduction of the stability of the micell structure of the grease occur.

The present invention will now be described in detail with reference to the following examples and comparative examples.

EXAMPLES 1 THROUGH 26 AND COMPARATIVE EXAMPLES 1 THROUGH 5

A base oil, a base grease, a heat-insulating agent, an extreme pressure additive, and a solid lubricant were mixed at a mixing ratio shown in Table 1, whereby lubricating agents of Examples 1 through 26 and Comparative Examples 1 through 5 were prepared. With respect to each of the so-obtained compositions, the performances were evaluated according to the test methods described below. The results are shown in Table 1.

Lubricating Property Test by Hot Lubricating Property Tester Model E-12

According to the principle of the hot lubricating property tester Model E-12, both ends of a test piece were fixed and the test piece induction-heated gripped between rolls while supplying an oil to the test piece, and a slip lubrication effected. The friction coefficient and seizure resistance of each lubricant were examined to evaluate the lubricating property.

Friction coefficient $\mu = T/R.W$ in which T represents a shaft torque, R represents a roll radius, and W represents a load. The outlines of the tester and the test conditions are as follows.

a) Type: lubricity tester of two-high type for slip lubricating b) Roll dimension: 124 mm (diameter)×80 mm (length)

c) Roll material: high chromium roll (Hs=70–75)

d) Test piece material: SS-41 [20 mm (height)×20 mm (width)×580 mm (length)]

e) Test piece temperature: 400° C., 600° C. and 800° C. (automatically adjusted)

f) Revolution: 200 rpm g) Rolling load: 500 to 3000 kgf (the load is increased by 500 kgf at every time)

h) Method of supplying lubricant: applying

B) Rust Prevention Test a) The test piece used at the test (A) was cut to a size of 20 mm×20 mm×100 mm.

b) The test piece prepared at a) above was hung under the eaves and allowed to stand for 2 weeks, and the state of rusting was checked.

o: no rusting x: extreme rusting

C) Water Washing Resistance Test a) A defatted and weighed steel sheet (SPCC-SD 100 mm×100 mm×0.8 mm) was uniformly coated with 30±3 mg of the lubricant.

b) The steel sheet prepared at a) above was washed with water under the following conditions, and the weight was measured after the water washing and the residual oil ratio is determined.

a) Nozzle model number: ¼ KBF 0865 b) Extrusion rate: 6.4 l/min (extrusion pressure=2.0 kgf/cm$^2$)

c) Water washing time: 5 seconds (water temperature=25° C.)

d) Distance between steel sheet and nozzle: 200 mm

Residual oil or grease ratio (%)=[(amount of residual oil or grease)/(amount coated of oil or grease)]×100

D) Measurement of Contact Heat Transfer Ratio between Metals a) Material of test piece: WT-60 [25 mm (diameter)×50 mm (length)]

b) Temperature: 780° C. (high-temperature material), 22 to 30° C. (low-temperature material)

c) Thermocouple: CA (0.5 mm) sheath (attachment position=1.5 mm, 3.0 mm)

d) Heat-insulating material: kao wool e) Compressive force: 500 kgf/cm$^2$ f) Method of filling sample and thickness:

As shown in FIG. 1, a high-temperature material 3 was pressed against a low-temperature material 2 coated with a sample 1, and the contact interface temperature of each sample and the heat flow flux were reckoned backward from the change of the temperatures of both materials with a lapse of time after the contact. The cooling law of Newton was applied in an extended manner to determine the heat transfer coefficient between the metals. The obtained coefficient was compared with the coefficient obtained when the sample is not coated, and the heat transfer ratio determined.

Note, in FIG. 1, reference numeral 4 represents a heat-insulating material and reference numeral 5 represents a thermocouple.

E) Roll Wearing Quantity Ratio in Actual Rolling Mill

Eight air spray nozzles (20 ml/min.nozzle) were attached to a work roll on the inlet side of F5 stand (6-stand mill), and about 300 tons of an ordinary material rolled by using nickel grain rolls. The wear quantity was measured and compared with the wear quantity observed when an oiling agent now available was used.

TABLE 1-1

| | | | Example 1 | Example 2 | Example 3 | Example 4 | Example 5 |
|---|---|---|---|---|---|---|---|
| Base Oil | mineral oil (ISO VG 430) | | 85 | | 85 | 85 | 85 |
| | synthetic oil (hydrocarbon type) | | | 85 | | | |
| Base Grease | lithium soap grease (mineral oil type) | | | | | | |
| | lithium soap grease (synthetic oil type) | | | | | | |
| | polyurea grease (mineral oil type) | | | | | | |
| | calcium complex grease (mineral oil type) | | | | | | |
| Heat-Insulating Agent | melting type (A) | $(KPO_3)_n$ | 10 | 10 | 10 | 10 | |
| | | $Na_2SiO_4$ | | | | | 10 |
| | | NaCl | | | | | |
| | non-melting type (B) | silicon nitride | 5 | 5 | | | 5 |
| | | amorphous carbon | | | 5 | | |
| | | silicon dioxide | | | | 5 | |
| Extreme Pressure Additive | zinc dialkyl dithiophosphate | | | | | | |
| | tricresyl phosphate | | | | | | |
| | sulfurized lard | | | | | | |

TABLE 1-1-continued

| | | | Example 1 | Example 2 | Example 3 | Example 4 | Example 5 |
|---|---|---|---|---|---|---|---|
| Solid Lubricant | graphite (artificial) | | | | | | |
| | mica (natural) | | | | | | |
| | boron nitride | | | | | | |
| | MCA | | | | | | |
| Consistency Number (JIS K 2220) | | | — | — | — | — | — |
| E-12 Model Hot Lubricating Performance Test | 400° C. | load resistance (kgf) | 2000 | 2000 | 2000 | 2000 | 2000 |
| | | μ under above load | 0.18 | 0.18 | 0.18 | 0.18 | 0.18 |
| | 600° C. | load resistance (kgf) | 1000 | 1000 | 1000 | 1000 | 1000 |
| | | μ under above load | 0.18 | 0.18 | 0.18 | 0.18 | 0.18 |
| | 800° C. | load resistance (kgf) | 500 | 500 | 500 | 500 | 500 |
| | | μ under above load | 0.18 | 0.18 | 0.18 | 0.18 | 0.18 |
| Rust Prevention Test | | | ○ | ○ | ○ | ○ | ○ |
| Water Washing Resistance Test (residual oil or grease ratio; %) | | | 45 | 46 | 45 | 44 | 46 |
| Contact Heat Transfer Ratio between Metals | | | 0.7–0.8 | 0.7–0.8 | 0.7–0.8 | 0.7–0.8 | 0.7–0.8 |
| Roll Wearing Ratio in Actual Rolling Mill | | | 0.8–0.9 | 0.8–0.9 | 0.8–0.9 | 0.8–0.9 | 0.8–0.9 |

TABLE 1-2

| | | | Example 6 | Example 7 | Example 8 | Example 9 | Example 10 |
|---|---|---|---|---|---|---|---|
| Base Oil | mineral oil (ISO VG 430) | | 85 | 82 | 80 | 77 | |
| | synthetic oil (hydrocarbon type) | | | | | | |
| Base Grease | lithium soap grease (mineral oil type) | | | | | | 90 |
| | lithium soap grease (synthetic oil type) | | | | | | |
| | polyurea grease (mineral oil type) | | | | | | |
| | calcium complex grease (mineral oil type) | | | | | | |
| Heat-Insulating Agent | melting type (A) | $(KPO_3)_n$ | | 10 | 10 | 10 | 10 |
| | | $Na_2SiO_4$ | | | | | |
| | | NaCl | 10 | | | | |
| | non-melting type (B) | silicon nitride | 5 | 5 | 5 | 5 | |
| | | amorphous carbon | | | | | |
| | | silicon dioxide | | | | | |
| Extreme Pressure Additive | zinc dialkyl dithiophosphate | | | 3 | | 3 | |
| | tricresyl phosphate | | | | | | |
| | sulfurized lard | | | | | | |
| Solid Lubricant | graphite (artificial) | | | | 5 | 5 | |
| | mica (natural) | | | | | | |
| | boron nitride | | | | | | |
| | MCA | | | | | | |
| Consistency Number (JIS K 2220) | | | — | — | — | — | 1 |
| E-12 Model Hot Lubricating Performance Test | 400° C. | load resistance (kgf) | 2000 | 2500 | 2500 | 3000 | 2000 |
| | | μ under above load | 0.18 | 0.17 | 0.17 | 0.15 | 0.18 |
| | 600° C. | load resistance (kgf) | 1000 | 1500 | 2000 | 2000 | 1000 |
| | | μ under above load | 0.18 | 0.16 | 0.16 | 0.15 | 0.18 |
| | 800° C. | load resistance (kgf) | 500 | 1000 | 1000 | 1500 | 500 |
| | | μ under above load | 0.18 | 0.16 | 0.18 | 0.16 | 0.18 |
| Rust Prevention Test | | | x | ○ | ○ | ○ | ○ |
| Water Washing Resistance Test (residual oil or grease ratio; %) | | | 46 | 47 | 60 | 60 | 80 |
| Contact Heat Transfer Ratio between Metals | | | 0.7–0.8 | 0.7–0.8 | 0.7–0.8 | 0.7–0.8 | 0.7–0.8 |
| Roll Wearing Ratio in Actual Rolling Mill | | | 0.8–0.9 | 0.5–0.6 | 0.6–0.7 | 0.5–0.6 | 0.8–0.9 |

TABLE 1-3

| | | | Example 11 | Example 12 | Example 13 | Example 14 | Example 15 |
|---|---|---|---|---|---|---|---|
| Base Oil | mineral oil (ISO VG 430) | | | | | | |
| | synthetic oil (hydrocarbon type) | | | | | | |
| Base Grease | lithium soap grease (mineral oil type) | | 90 | 80 | 87 | 87 | 87 |
| | lithium soap grease (synthetic oil type) | | | | | | |
| | polyurea grease (mineral oil type) | | | | | | |
| | calcium complex grease (mineral oil type) | | | | | | |
| Heat-Insulating Agent | melting type (A) | $(KPO_3)_n$ | | 10 | 10 | 10 | 10 |
| | | $Na_2SiO_4$ | | | | | |
| | | NaCl | | | | | |
| | non-melting type (B) | silicon nitride | 10 | 10 | | | |
| | | amorphous carbon | | | | | |
| | | silicon dioxide | | | | | |
| Extreme Pressure Additive | zinc dialkyl dithiophosphate | | | | 3 | | |
| | tricresyl phosphate | | | | | 3 | |
| | sulfurized lard | | | | | | 3 |
| Solid Lubricant | graphite (artificial) | | | | | | |
| | mica (natural) | | | | | | |
| | boron nitride | | | | | | |
| | MCA | | | | | | |
| Consistency Number (JIS K 2220) | | | 1 | 1 | 1 | 1 | 1 |

TABLE 1-3-continued

| | | | Example 11 | Example 12 | Example 13 | Example 14 | Example 15 |
|---|---|---|---|---|---|---|---|
| E-12 Model Hot Lubricating Performance Test | 400° C. | load resistance (kgf) | 2000 | 2500 | 3000 | 3000 | 3000 |
| | | μ under above load | 0.18 | 0.18 | 0.14 | 0.14 | 0.14 |
| | 600° C. | load resistance (kgf) | 1000 | 1500 | 2000 | 2000 | 2000 |
| | | μ under above load | 0.18 | 0.17 | 0.17 | 0.17 | 0.17 |
| | 800° C. | load resistance (kgf) | 500 | 1000 | 1500 | 1500 | 1500 |
| | | μ under above load | 0.18 | 0.17 | 0.16 | 0.16 | 0.16 |
| Rust Prevention Test | | | ○ | ○ | ○ | ○ | ○ |
| Water Washing Resistance Test (residual oil or grease ratio; %) | | | 80 | 85 | 81 | 81 | 81 |
| Contact Heat Transfer Ratio between Metals | | | 0.7–0.8 | 0.6–0.7 | 0.7–0.8 | 0.7–0.8 | 0.7–0.8 |
| Roll Wearing Ratio in Actual Rolling Mill | | | 0.8–0.9 | 0.7–0.8 | 0.7–0.8 | 0.7–0.8 | 0.7–0.8 |

TABLE 1-4

| | | | Example 16 | Example 17 | Example 18 | Example 19 | Example 20 |
|---|---|---|---|---|---|---|---|
| Base Oil | mineral oil (ISO VG 430) | | | | | | |
| | synthetic oil (hydrocarbon type) | | | | | | |
| Base Grease | lithium soap grease (mineral oil type) | | 85 | 85 | 85 | 85 | 77 |
| | lithium soap grease (synthetic oil type) | | | | | | |
| | polyurea grease (mineral oil type) | | | | | | |
| | calcium complex grease (mineral oil type) | | | | | | |
| Heat-Insulating Agent | melting type (A) | $(KPO_3)_n$ | 10 | 10 | 10 | 10 | 10 |
| | | $Na_2SiO_4$ | | | | | |
| | | NaCl | | | | | |
| | non-melting type (B) | silicon nitride | | | | | 10 |
| | | amorphous carbon | | | | | |
| | | silicon dioxide | | | | | |
| Extreme Pressure Additive | zinc dialkyl dithiophosphate | | | | | | |
| | tricresyl phosphate | | | | | | |
| | sulfurized lard | | | | | | |
| Solid Lubricant | graphite (artificial) | | 5 | | | | |
| | mica (natural) | | | 5 | | | |
| | boron nitride | | | | 5 | | |
| | MCA | | | | | 5 | |
| Consistency Number (JIS K 2220) | | | 1 | 1 | 1 | 1 | 1 |
| E-12 Model Hot Lubricating Performance Test | 400° C. | load resistance (kgf) | 3000 | 3000 | 3000 | 2500 | 3000 |
| | | μ under above load | 0.15 | 0.14 | 0.14 | 0.18 | 0.15 |
| | 600° C. | load resistance (kgf) | 2000 | 2000 | 2000 | 1500 | 3000 |
| | | μ under above load | 0.18 | 0.18 | 0.18 | 0.18 | 0.15 |
| | 800° C. | load resistance (kgf) | 1500 | 1500 | 1500 | 1000 | 2000 |
| | | μ under above load | 0.17 | 0.17 | 0.17 | 0.17 | 0.17 |
| Rust Prevention Test | | | ○ | ○ | ○ | ○ | ○ |
| Water Washing Resistance Test (residual oil or grease ratio; %) | | | 86 | 86 | 87 | 86 | 86 |
| Contact Heat Transfer Ratio between Metals | | | 0.6–0.7 | 0.6–0.7 | 0.6–0.7 | 0.7–0.8 | 0.6–0.7 |
| Roll Wearing Ratio in Actual Rolling Mill | | | 0.6–0.7 | 0.6–0.7 | 0.6–0.7 | 0.7–0.8 | 0.5–0.6 |

TABLE 1-5

| | | | Example 21 | Example 22 | Example 23 | Example 24 | Example 25 |
|---|---|---|---|---|---|---|---|
| Base Oil | mineral oil (ISO VG 430) | | | | | | |
| | synthetic oil (hydrocarbon type) | | | | | | |
| Base Grease | lithium soap grease (mineral oil type) | | 72 | 47 | | | |
| | lithium soap grease (synthetic oil type) | | | | 72 | | |
| | polyurea grease (mineral oil type) | | | | | 72 | |
| | calcium complex grease (mineral oil type) | | | | | | 72 |
| Heat-Insulating Agent | melting type (A) | $(KPO_3)_n$ | 10 | 25 | 10 | 10 | 10 |
| | | $Na_2SiO_4$ | | | | | |
| | | NaCl | | | | | |
| | non-melting type (B) | silicon nitride | 10 | 10 | 5 | 5 | 5 |
| | | amorphous carbon | | | | | |
| | | silicon dioxide | | | | | |
| Extreme Pressure Additive | zinc dialkyl dithiophosphate | | 3 | 3 | 3 | 3 | 3 |
| | tricresyl phosphate | | | | | | |
| | sulfurized lard | | | | | | |
| Solid Lubricant | graphite (artificial) | | 5 | 15 | 10 | 10 | 10 |
| | mica (natural) | | | | | | |
| | boron nitride | | | | | | |
| | MCA | | | | | | |
| Consistency Number (JIS K 2220) | | | 1 | 2 | 1 | 1 | 1 |
| E-12 Model Hot Lubricating Performance Test | 400° C. | load resistance (kgf) | 3000 | 3000 | 3000 | 3000 | 3000 |
| | | μ under above load | 0.14 | 0.06 | 0.14 | 0.14 | 0.14 |
| | 600° C. | load resistance (kgf) | 3000 | 3000 | 3000 | 3000 | 3000 |
| | | μ under above load | 0.15 | 0.08 | 0.15 | 0.15 | 0.15 |
| | 800° C. | load resistance (kgf) | 2500 | 3000 | 2000 | 2000 | 2500 |

TABLE 1-5-continued

| | | Example 21 | Example 22 | Example 23 | Example 24 | Example 25 |
|---|---|---|---|---|---|---|
| | μ under above load | 0.16 | 0.10 | 0.16 | 0.16 | 0.14 |
| Rust Prevention Test | | ○ | ○ | ○ | ○ | ○ |
| Water Washing Resistance Test (residual oil or grease ratio; %) | | 87 | 93 | 87 | 89 | 87 |
| Contact Heat Transfer Ratio between Metals | | 0.6–0.7 | 0.5–0.6 | 0.6–0.7 | 0.6–0.7 | 0.6–0.7 |
| Roll Wearing Ratio in Actual Rolling Mill | | 0.5–0.6 | 0.2–0.3 | 0.3–0.4 | 0.3–0.4 | 0.3–0.4 |

TABLE 1-6

| | | | Example 26 | Comparative Example 1 | Comparative Example 2 | Comparative Example 3 |
|---|---|---|---|---|---|---|
| Base Oil | mineral oil (ISO VG 430) | | | 90 | | |
| | synthetic oil (hydrocarbon type) | | | | | |
| Base Grease | lithium soap grease (mineral oil type) | | | | 87 | 72 |
| | lithium soap grease (synthetic oil type) | | | | | |
| | polyurea grease (mineral oil type) | | 90 | | | |
| | calcium complex grease (mineral oil type) | | | | | |
| Heat-Insulating Agent | melting type (A) | $(KPO_3)_n$ | 10 | 10 | | 10 |
| | | $Na_2SiO_4$ | | | | |
| | | NaCl | | | | |
| | non-melting type (B) | silicon nitride | | | | |
| | | amorphous carbon | | | | |
| | | silicon dioxide | | | | nickel powder 10 (note 1) |
| Extreme Pressure Additive | zinc dialkyl dithiophosphate | | | | 3 | 3 |
| | tricresyl phosphate | | | | | |
| | sulfurized lard | | | | | |
| Solid Lubricant | graphite (artificial) | | | | 10 | 5 |
| | mica (natural) | | | | | |
| | boron nitride | | | | | |
| | MCA | | | | | |
| Consistency Number (JIS K 2220) | | | | — | — | — |
| E-12 Model Hot Lubricating Performance Test | 400° C. | load resistance (kgf) | 2500 | 1500 | 2500 | 3000 |
| | | μ under above load | 0.18 | 0.18 | 0.16 | 0.14 |
| | 600° C. | load resistance (kgf) | 1500 | 500 | 1500 | 3000 |
| | | μ under above load | 0.17 | 0.17 | 0.16 | 0.16 |
| | 800° C. | load resistance (kgf) | 1000 | 500> | 1000 | 2500 |
| | | μ under above load | 0.18 | — | 0.17 | 0.17 |
| Rust Prevention Test | | | ○ | ○ | ○ | ○ |
| Water Washing Resistance Test (residual oil or grease ratio; %) | | | 80 | 40 | 80 | 87 |
| Contact Heat Transfer Ratio between Metals | | | 0.7–0.8 | 0.9–1.0 | 0.9–1.0 | 0.8–0.9 |
| Roll Wearing Ratio in Actual Rolling Mill | | | 0.8–0.9 | 0.9–1.0 | 0.7–0.8 | 0.7–0.8 |

Note 1
heat conductivity = 0.22 cal/cm · s · °C.
melting point = 1455° C.

TABLE 1-7

| | | | Comparative Example 4 | Comparative Example 5 | Comparative Example 6 |
|---|---|---|---|---|---|
| Base Oil | mineral oil (ISO VG 430) | | Commercial hot rolling oil (A) (oil used at present) | Commercial hot rolling oil (B) (containing 10% of graphite) | lubricating agent not added |
| | synthetic oil (hydrocarbon type) | | | | |
| Base Grease | lithium soap grease (mineral oil type) | | | | |
| | lithium soap grease (synthetic oil type) | | | | |
| | polyurea grease (mineral oil type) | | | | |
| | calcium complex grease (mineral oil type) | | | | |
| Heat-Insulating Agent | melting type (A) | $(KPO_3)_n$ | | | |
| | | $Na_2SiO_4$ | | | |
| | | NaCl | | | |
| | non-melting type (B) | silicon nitride | | | |
| | | amorphous carbon | | | |
| | | silicon dioxide | | | |
| Extreme Pressure Additive | zinc dialkyl dithiophosphate | | | | |
| | tricresyl phosphate | | | | |
| | sulfurized lard | | | | |
| Solid Lubricant | graphite (artificial | | | | |
| | mica (natural) | | | | |
| | boron nitride | | | | |
| | MCA | | | | |
| Consistency Number (JIS K 2220) | | | — | | — |
| E-12 Model Hot Lubricating Performance Test | 400° C. | load resistance (kgf) | 500 | 2000 | 500> |
| | | μ under above load | 0.10 | 0.08 | — |
| | 600° C. | load resistance (kgf) | 500 | 1000 | 500> |
| | | μ under above load | 0.16 | 0.10 | — |

TABLE 1-7-continued

| | | Comparative Example 4 | Comparative Example 5 | Comparative Example 6 |
|---|---|---|---|---|
| 800° C. | load resistance (kgf) | 500> | 500 | 500> |
| | μ under above load | — | 0.10 | — |
| Rust Prevention Test | | ∘ | ∘ | ∘ |
| Water Washing Resistance Test (residual oil or grease ratio; %) | | 31 | 55 | — |
| Contact Heat Transfer Ratio between Metals | | 1 | 0.8–0.9 | 1 |
| Roll Wearing Ratio in Actual Rolling Mill | | 1 | 0.5–0.6 | 1< |

Industrial Applicability

The lubricating composition of the present invention exerts an effect of reducing the thermal crown of a work roll, which has an influence on the quality of a product, in the field of hot rolling steel, and is especially valuable in this field.

We claim:

1. A lubricating composition for hot-rolling steel, which consists essentially of a base oil or base grease; a combination of heat-insulating agents (A) and (B), in which the heat-insulating agent (A) is an inorganic compound which is melted by an absorption of heat at a temperature lower than 1200° C., and the heat-insulating agent (B) is an inorganic powder which is not melted or decomposed at a temperature lower than 1200° C. and has a heat conductivity lower than 0.01 cal/cm.s. °C. at room temperature and a friction coefficient smaller than 0.7; an extreme pressure additive; and a solid lubricant, wherein said combination of heat-insulating agents (A) and (B) is selected from the group consisting of a combination of a condensed phosphoric acid salt as (A) and silicon nitride as (B); a combination of a condensed phosphoric acid salt as (A) and amorphous carbon as (B); a combination of a condensed phosphoric acid salt as (A) and silicon dioxide as (B); and a combination of sodium chloride as (A) and silicon nitride as (B), said extreme pressure additive is selected from the group consisting of zinc dialkyldithiophosphate, tricresyl phosphate and sulfurized lard, said solid lubricant is selected from the group consisting of graphite, molybdenum disulfide, mica and a melamine/cyanuric acid adduct, and said heat-insulating agents (A) and (B) are contained in the composition in a weight ratio of from 49/1 to 1/49 and in a total amount of 5 to 50% by weight of the composition.

2. A lubricating composition for hot-rolling steel according to claim 1, wherein the base oil is a member selected from the group consisting of spindle oil, machine oil, dynamo oil, motor oil, cylinder oil, bright stock, beef tallow, lard, sperm oil, palm oil, coconut oil, linseed oil, rice bran oil, soybean oil, esters of fatty acids having 8 to 22 carbon atoms with monohydric and polyhydric alcohols, α-olefins, polybutene, silicone oils and fluorine oils.

3. A lubricating composition for hot-rolling steel according to claim 1, wherein the base grease is a member selected from the group consisting of lithium soap grease, calcium soap grease, sodium soap grease, aluminum soap grease, calcium complex grease, polyurea grease and organo-clay grease.

* * * * *